US007430891B1

(12) United States Patent
Wang

(10) Patent No.: US 7,430,891 B1
(45) Date of Patent: Oct. 7, 2008

(54) PNEUMATIC DENT REMOVING TOOL FOR SHEET METAL

(76) Inventor: Shih-Ming Wang, No. 10, Yiwun St., Taiping City, Taichung County 411 (TW)

( * ) Notice: Subject to any disclaimer, the term of this patent is extended or adjusted under 35 U.S.C. 154(b) by 32 days.

(21) Appl. No.: 11/748,080

(22) Filed: May 14, 2007

(51) Int. Cl.
*B21J 13/08* (2006.01)

(52) U.S. Cl. ..... 72/457; 72/453.01; 72/478; 72/705

(58) Field of Classification Search ..... 72/54, 72/370.22, 379.2, 453.01, 457, 478, 479, 72/480, 705; 294/64.1, 64.2
See application file for complete search history.

(56) References Cited

U.S. PATENT DOCUMENTS 2,771,933 A * 11/1956 Edwards ..... 72/56
4,753,104 A * 6/1988 Strozier ..... 72/457
5,727,418 A * 3/1998 Strozier ..... 72/457
6,536,250 B1 * 3/2003 Borchert ..... 72/37
7,222,901 B2 * 5/2007 Gebauer et al. ..... 294/64.1

* cited by examiner

*Primary Examiner*—Edward Tolan
(74) *Attorney, Agent, or Firm*—Ming Chow Sinorica, LLC

(57) ABSTRACT

A pneumatic dent removing tool, wherein a sleeve is sheathed onto a vacuum ejector, and the inner screw thread of the sleeve is screwed to the outer screw thread of the vacuum ejector such that the combination of the free space of the vacuum ejector and the sleeve are sealed together. An air tube fitting opening is connected with an air tube which contains a suction cup. A jet faucet fitting opening connects with a jet faucet, and the jet faucet is connected with an air supply hose. The user need only eject the high pressure air into the vacuum ejector to generate suction under the suction cup. This process achieves the function of saving time and effort, increasing user safety, and decreasing the negative impact on the strength of the sheet metal.

2 Claims, 7 Drawing Sheets

PNEUMATIC DENT REMOVING TOOL FOR SHEET METAL

BACKGROUND OF THE INVENTION

1. Field of the Invention

The present invention relates to a dent removing tool. More particularly, the present invention relates to a dent removing tool which is used for restoring the original contour of sheet metal.

2. Description of Related Art

One conventional method for repairing a dent in sheet metal is to first disassemble the sheet metal, to next hammer the dent from its reverse side (not shown), and lastly to level the hammered surface to obtain a smooth surface. The aforesaid method contains some improvable defects, such as:

1. Time and effort consumption: this method requires that the sheet metal first be disassembled, then hammered, then leveled. The process of removing a dent takes a long time to accomplish and leveling the surface of the metal after the dent has been hammered out requires a great deal of effort. Therefore, the conventional method consumes a large amount of time and effort.

2. Strength reduction: This conventional method removes the dent by hammering, and this method changes the character of the sheet metal. This change in turn reduces the strength of the sheet metal.

Another conventional method uses a suction tool which comprises a suction cup at one end, and a handle at other end (not shown). Pressing the suction cup against the dent of the sheet metal draws out the air within the suction cup so that the suction cup grips the sheet metal tightly. When pulled back by the handle, the suction cup creates a counterforce which sucks the dent outward, restoring the sheet metal to its original contour. The aforesaid method also contains some improvable defects, such as:

1. Poor safety: the suction under the suction cup is small. If the force used to pull the suction cup from the metal is greater than the force of suction itself, the suction cup will dislodge from the metal, resulting in risk that the user will fall down and sustain injury.

The present invention is intended to improve upon the above mentioned drawbacks.

SUMMARY OF THE INVENTION

The primary object of the present invention is to provide a dent removing tool for sheet metal, which comprises: a vacuum ejector having an air tube fitting opening at one end, and a jet faucet fitting opening at the other end. The surface of the vacuum ejector includes an outer screw thread and a free space with a contracted diameter. A first outlet is installed on said surface, and a second outlet is installed on the outer surface of the jet faucet fitting opening. The second outlet leads to the said free space, and the air tube fitting opening leads to and connects to the first vacuum passage. The first vacuum passage is connected to the jet faucet fitting opening by means of an auxiliary passage. In addition, the jet faucet fitting opening is connected to a second vacuum passage, and the second vacuum passage is connected to the first outlet. A sleeve is sheathed onto the vacuum ejector, and an inner screw thread is installed in said sleeve so that the outer screw thread of the vacuum ejector will screw into the sleeve. The air tube fitting opening is connected with an air tube which contains a suction cup. The jet faucet fitting opening is connected with a jet faucet, and the jet faucet is connected with an air supply hose. The high pressure of air inputs to the inner passage of the vacuum ejector creates pressure differences such that the suction cup creates enough suction to draw at the sheet metal and remove the dent. This process achieves the function of saving time and effort, increasing user safety, and decreasing the negative impact on the strength of the sheet metal.

Other objects, advantages and novel features of the invention will become more apparent in the following detailed description taken in conjunction with the accompanying diagrams.

DETAILED DESCRIPTION OF PREFERRED EMBODIMENT

Figure 1:
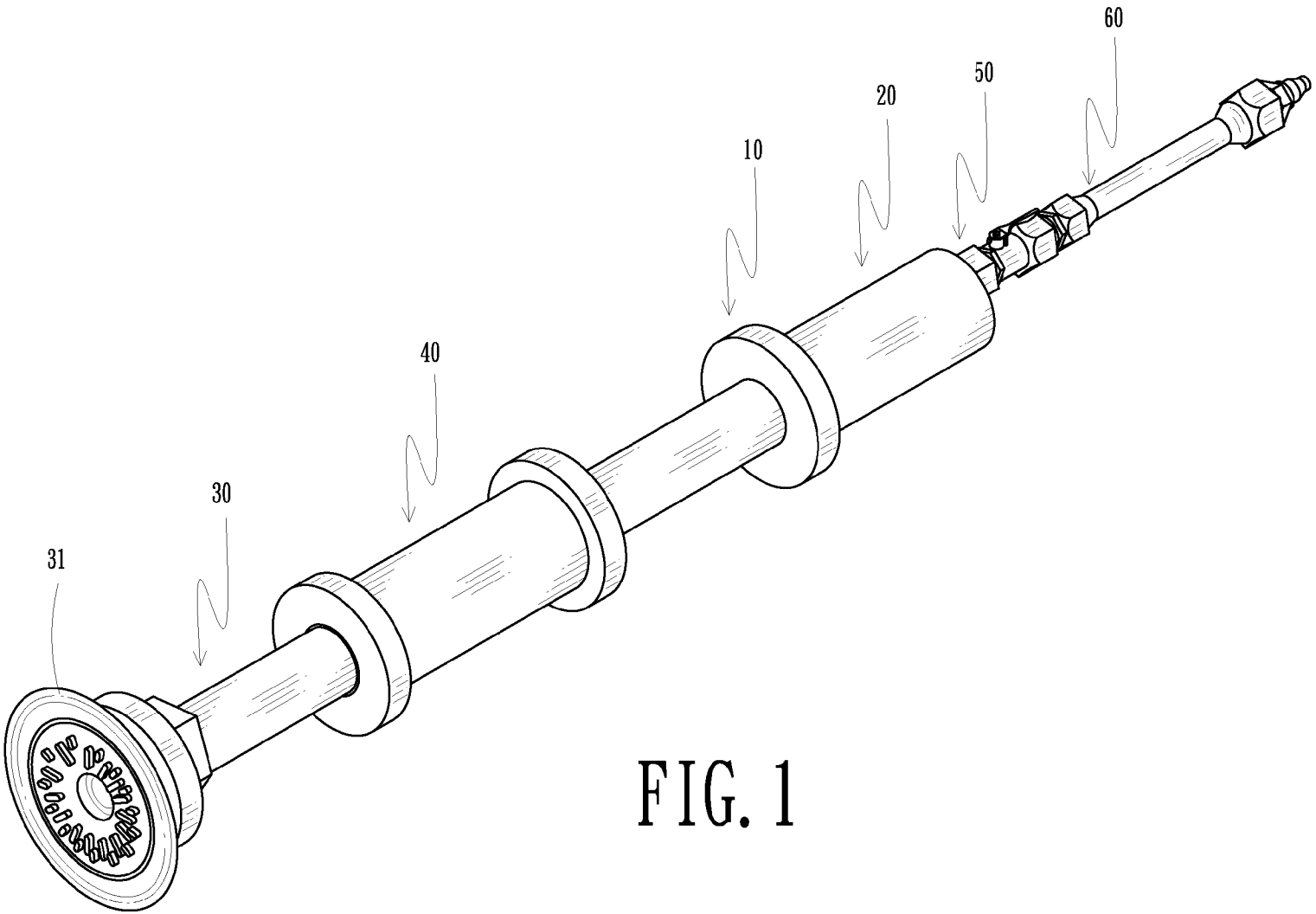
FIG. 1 is a perspective view schematically showing the dent removing tool of the present invention.
Figure 2:
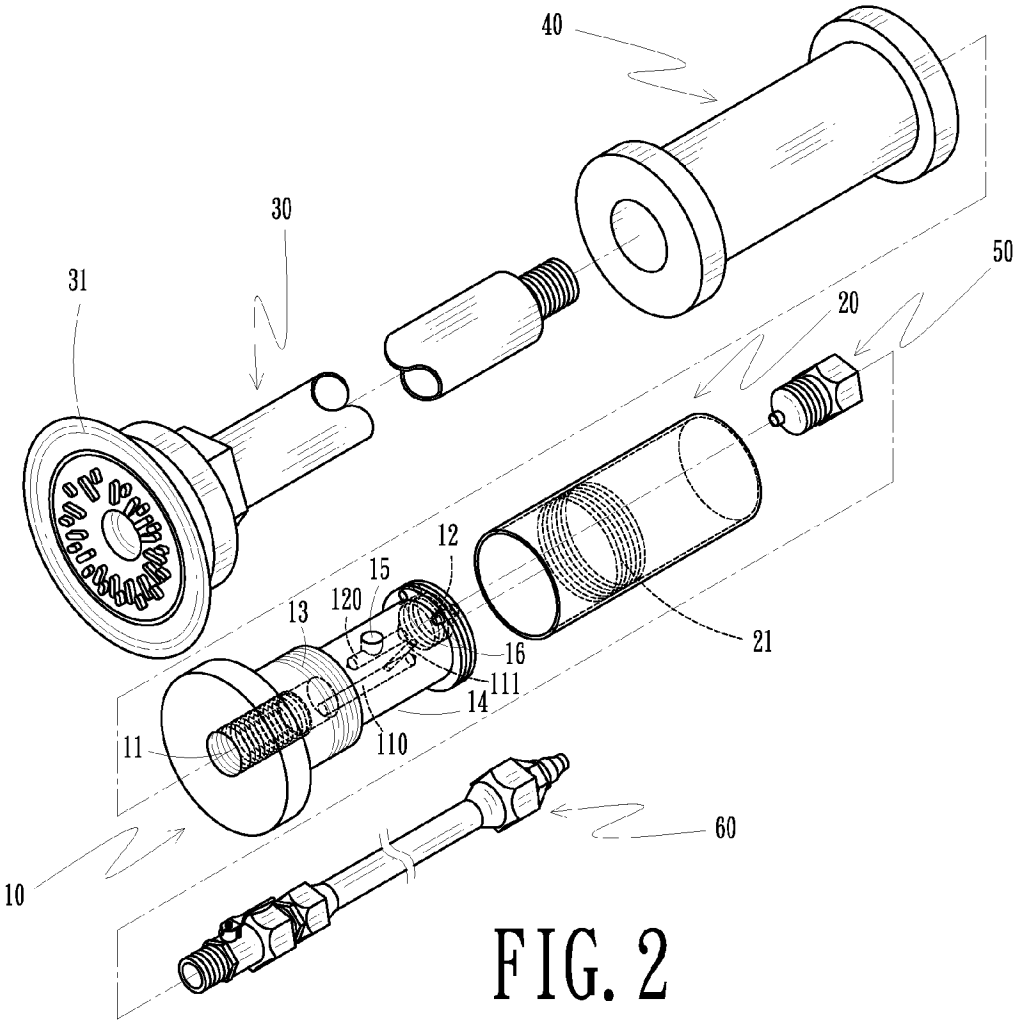
FIG. 2 is a segmented view of the dent removing tool of the present invention.
Figure 3:
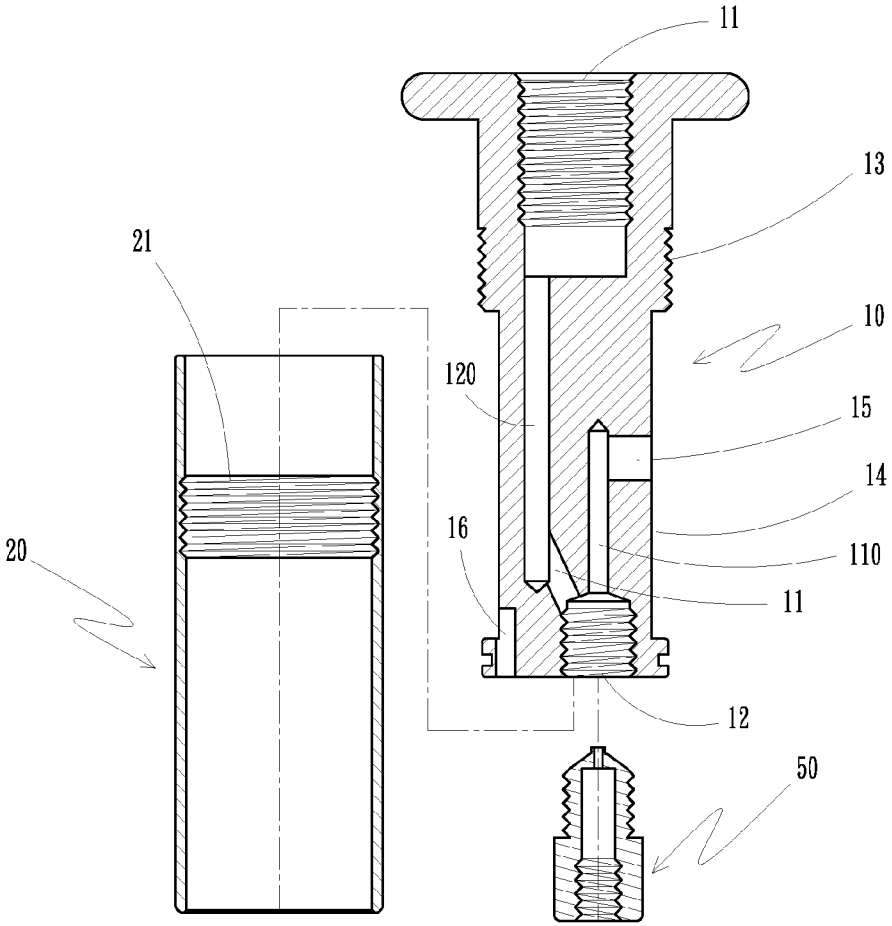
FIG. 3 is a segmented view, in partial section, of the dent removing tool of the present invention.
Figure 4:
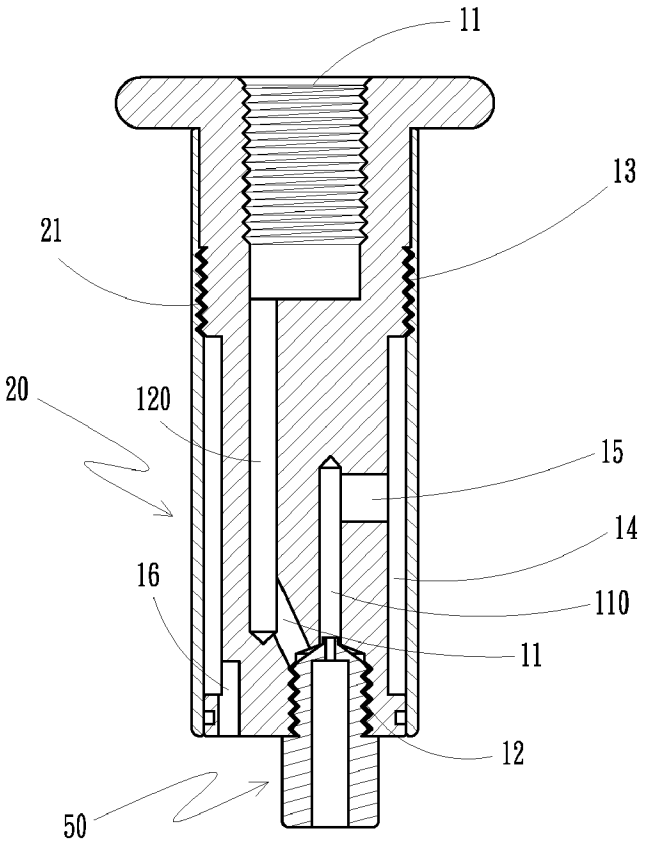
FIG. 4 is a side elevation view, in partial section, of the dent removing tool of the present invention.

While this invention is capable of embodiment in many different forms, shown in the drawings and herein described in detail is the preferred embodiment of the invention. The preferred embodiment is disclosed with the understanding that the present description is but one example of the principles of the invention and is not intended to limit the broad aspects of the invention to the single embodiment illustrated.

FIGS. 1 to 4 are perspective, segmented, partially segmented and side elevation views schematically showing the dent removing tool of the present invention.

The tool comprises:

a vacuum ejector 10 having an air tube fitting opening 11 at one end, and a jet faucet fitting opening 12 at other end. The surface of the vacuum ejector 10 includes an outer screw thread 13 and a free space 14 with a contracted diameter, wherein a first outlet 15 is installed on said surface 14, and a second outlet 16 is installed on the outer surface of the jet faucet fitting opening 12. The second outlet 16 leads to the said free space 14, and the air tube fitting opening 11 leads to and connects to a first vacuum passage 110. The first vacuum passage 110 is connected to the jet faucet fitting opening 12 by means of an auxiliary passage 111. In addition, the jet faucet fitting opening 12 connects to a second vacuum passage 120, and the second vacuum passage 120 connects to the first outlet 15; and a sleeve 20 sheathed onto the vacuum ejector 10, and an inner screw thread 21 installed in said sleeve 20 so that the outer screw thread 13 of the vacuum ejector 10 will screw into the sleeve 20. The air tube fitting opening 11 is connected with an air tube 30 which contains a suction cup 31. The jet faucet fitting opening 12 is connected with a jet faucet 50, and the jet faucet 50 is connected with an air supply hose 60.

In light of the structures described above, the present invention achieves the function of removing dents from sheet metal.

Figure 5:
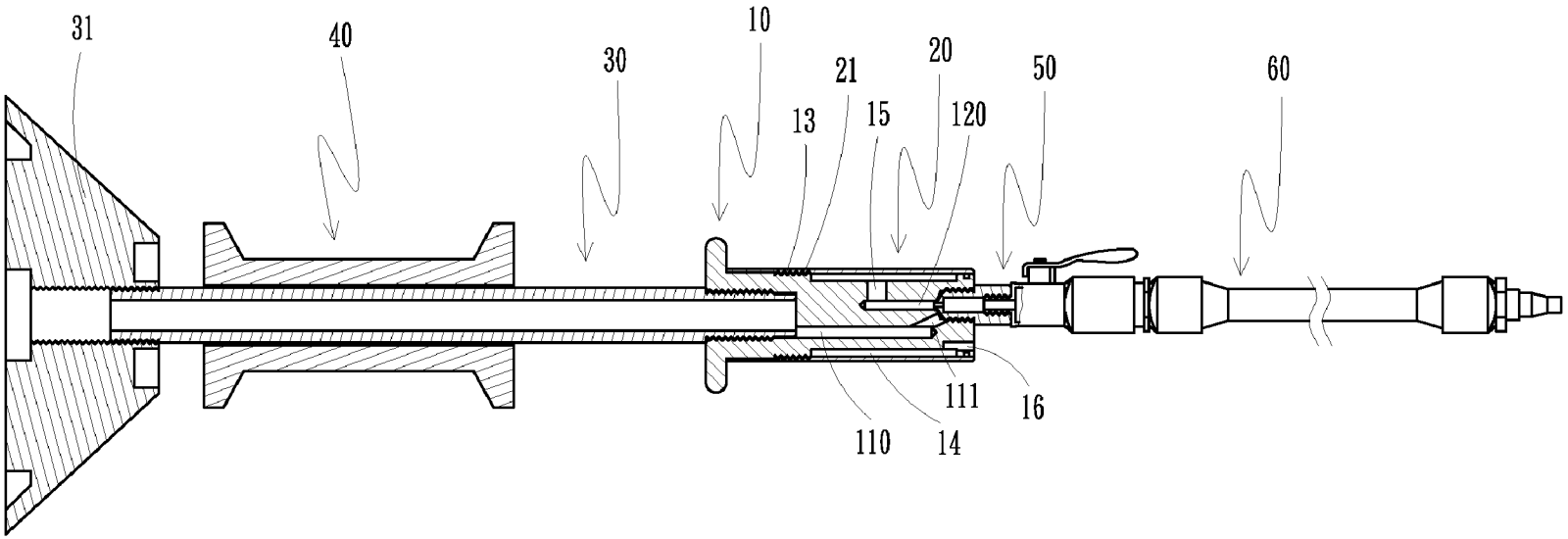
FIG. 5 is a cross-sectional view schematically showing the dent removing tool of the present invention.

FIG. 5 is a cross-sectional view schematically showing the dent removing tool of the present invention. As given above, the sleeve 20 is sheathed onto the vacuum ejector 10, and the outer screw thread 13 of the vacuum ejector 10 is screwed into the inner screw thread 21 of the sleeve 20. The free space 14 of the vacuum ejector 10 and the sleeve 20 are thus sealed. The air tube fitting opening 11 is connected with an air tube 30 which has a suction cup 31. The jet faucet fitting opening 12 is connected with a jet faucet 50, and the outlet of the jet faucet 50 connects to the second vacuum passage 120, while the inlet of jet faucet 50 is connected with an air supply hose 60.

Figure 6:
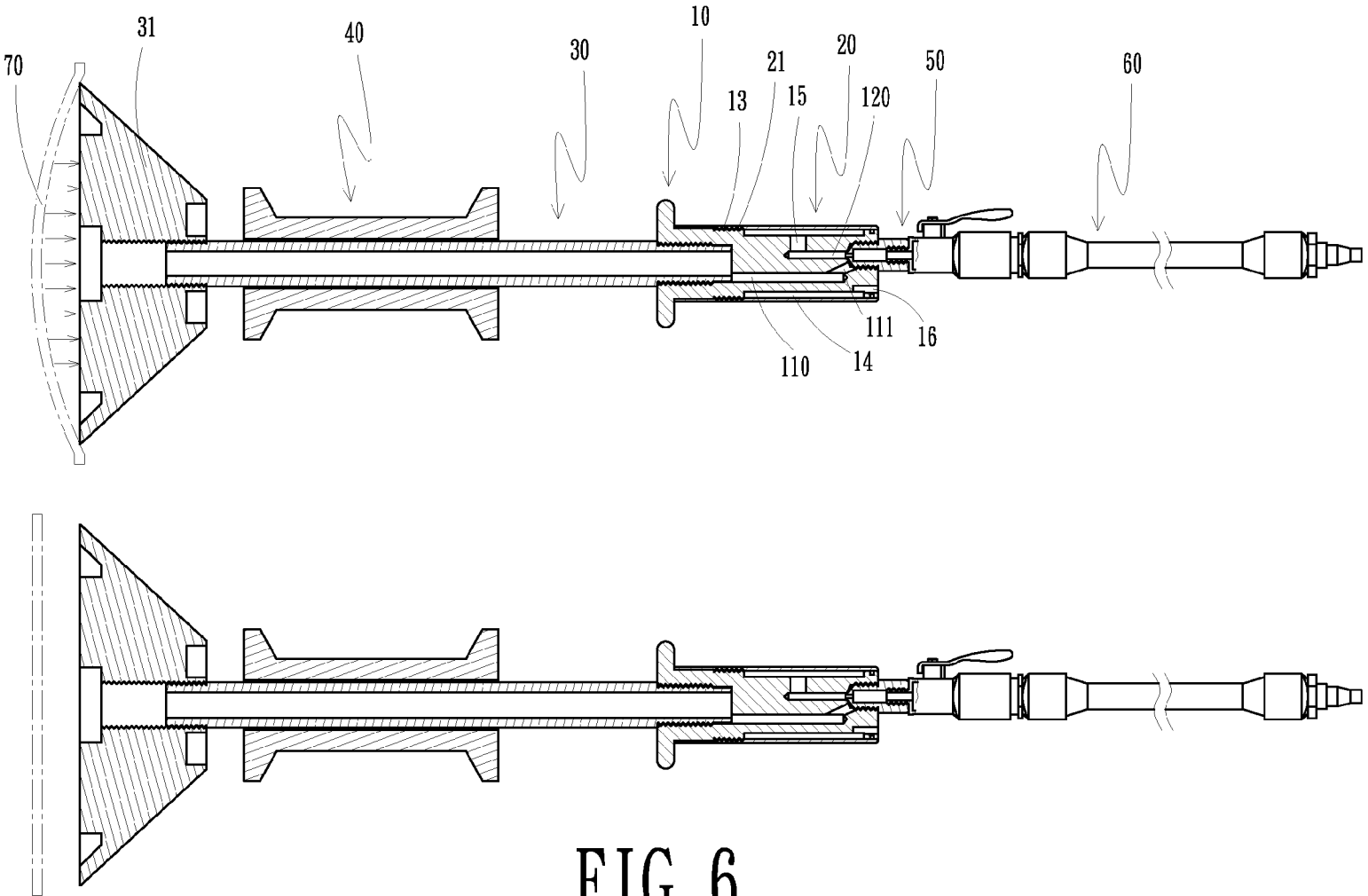
FIG. 6 is a cross-sectional view schematically showing the dent removing tool of the present invention.

FIG. 6 is a cross-sectional view schematically showing the dent removing tool of the present invention. The high pressure air will input into the jet faucet 50 via the air supply hose 60, and the air continues further to the second vacuum passage 120 from the outlet of said jet faucet 50 where it then enters the first outlet 15 which is connected to the second vacuum passage 120. The air then leads to the sealed free space 14 which connects to the first outlet 15 and finally exhausts from the second outlet 16. According to Bernoulli's Law, the higher the speed of the fluid, the lower the pressure. Therefore, the auxiliary passage 111, which connects to the first vacuum passage 110, builds up high pressure such that the air in the first vacuum passage 110, air tube 30 and suction cup 21 flows to the first outlet 15 to exhaust. Thus the inner space of the suction cup 31 becomes a vacuum, creating tight suction between the suction cup 31 and the sheet metal 70. When suction is accomplished, the inside of the tool will maintain atmospheric pressure as long as the supply of high pressure is stopped, at which point the suction cup 31 will dislodge from the sheet metal 70. In addition, the tool can be used to move an object containing a flat panel by suctioning the suction cup 30 to the panel and moving the object by holding the air tube 30. This is another practical use of the present invention.

Figure 7:
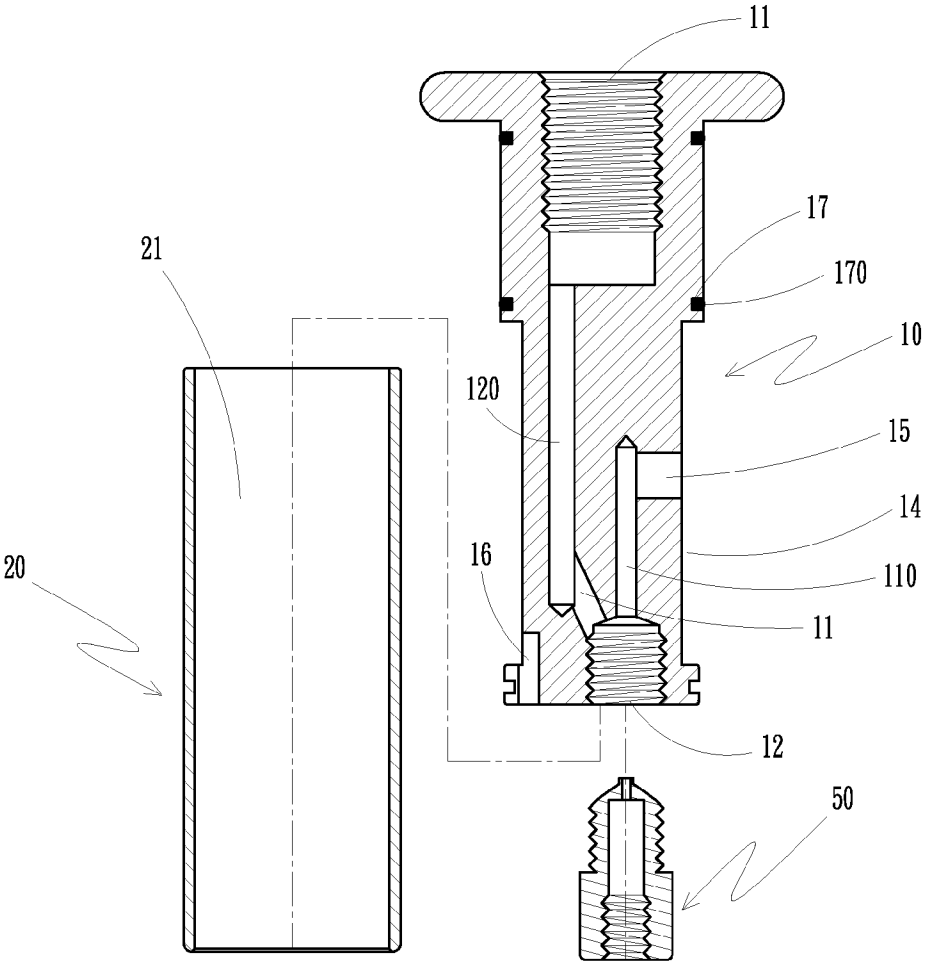
FIG. 7 is a segmented view, in partial section, of another aspect.

FIG. 7 is a segmented view, in partial section, of another aspect of the dent removing tool.

The tool comprises:

a vacuum ejector 10 having an air tube fitting opening 11 at one end, and a jet faucet fitting opening 12 at other end. The surface of the vacuum ejector 10 includes circular troughs 17 and a free space 14 with a contracted diameter, wherein, an O-ring 170 is installed on said circular trough 17. A first outlet 15 is installed on said surface 14, and a second outlet 16 is installed on the outer surface of the jet faucet fitting opening 12. The second outlet 16 leads to said free space 14, and the air tube fitting opening 11 leads to and connects to a first vacuum passage 110. The first vacuum passage 110 connects to the jet faucet fitting opening 12 by means of an auxiliary passage 111. In addition, the jet faucet fitting opening 12 connects to a second vacuum passage 120, and the second vacuum passage 120 connects with the first outlet 15; and a sleeve 20 sheathed onto the vacuum ejector 10, and the combination of the free space 14 of the vacuum ejector 10 and the sleeve 20 are sealed together by virtue of the O-ring 170 on the encircling trough 17. The air tube fitting opening 11 is connected with an air tube 30 which has a suction cup 31. The jet faucet fitting opening 12 is connected with a jet faucet 50, and the jet faucet 50 is connected with an air supply hose 60.

In light of the structures described above, the advantages of the present invention include:

1. Time and effort saving: the user need only eject the high pressure air into the vacuum ejector to generate suction under the suction cup. The time of said operation is very short and ease of use is very high.

2. Increased safety: the force of suction against the sheet metal is evenly distributed under the suction cup, and this prevents accidental dislodge from the sheet metal which could lead to user injury.

3. Decrease of change to material's character: the tool uses the suction cup to pull the dent in the direction opposite the dent, and change to the material's character is decreased as compared to conventional dent repair methods.

Although numerous characteristics and advantages of the present invention have been set forth in the foregoing description, together with details of the structure and function of the invention, this disclosure is one example only, and changes may be made with regard to specific details, particularly in matters of shape, size, and arrangement of parts within the invention to the full extent indicated by the general meaning of the terms in which the appended claims are expressed.

What is claimed is:

1. A pneumatic dent removing tool, comprising:

a vacuum ejector having an air tube fitting opening at one end, and a jet faucet fitting opening at other end; the surface of the vacuum ejector includes an outer screw thread and a free space with a contracted diameter, wherein a first outlet is installed on said surface, and a second outlet is installed on the outer surface of the jet faucet fitting opening; the second outlet is led to the said free space, and the air tube fitting opening is led to and connects to a first vacuum passage; the first vacuum passage connects to the jet faucet fitting opening by means of an auxiliary passage; in addition, the jet faucet fitting opening connects to a second vacuum passage, and the second vacuum passage connects to the first outlet; and a sleeve is sheathed onto the vacuum ejector, and an inner screw thread is installed in said sleeve so that the outer screw thread of the vacuum ejector screws into the sleeve; the air tube fitting opening connects with an air tube which has a suction cup; the jet faucet fitting opening connects with a jet faucet, and the jet faucet is connected with an air supply hose.

2. A pneumatic dent removing tool, comprising:

a vacuum ejector having an air tube fitting opening at one end, and a jet faucet fitting opening at other end; the surface of the vacuum ejector includes circular troughs and a free space with a contracted diameter, wherein, an O-ring is installed on such circular trough, a first outlet is installed on said surface, and a second outlet is installed on the outer surface of the jet faucet fitting opening; the second outlet leads to the said free space, and the air tube fitting opening leads to and connects with the first vacuum passage; the first vacuum passage is connected to the jet faucet fitting opening by means of an auxiliary passage; in addition, the jet faucet fitting opening connects to a second vacuum passage, and the second vacuum passage connects to the first outlet; and a sleeve is sheathed onto the vacuum ejector, and the combination of the free space of the vacuum ejector and the sleeve are sealed by virtue of the O-ring on the circular trough; the air tube fitting opening is connected with an air tube which has a suction cup; the jet faucet fitting opening connects with a jet faucet, and the jet faucet is connected with an air supply hose.

* * * * *